US007216963B2

(12) United States Patent
Takagi

(10) Patent No.: US 7,216,963 B2
(45) Date of Patent: May 15, 2007

(54) INK CARTRIDGE AND INK-JET RECORDING APPARATUS USING THE INK CARTRIDGE

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 261 days.

(21) Appl. No.: 10/899,044

(22) Filed: Jul. 27, 2004

(65) Prior Publication Data

US 2005/0024432 A1 Feb. 3, 2005

(30) Foreign Application Priority Data

Jul. 31, 2003 (JP) ..... 2003-204552

(51) Int. Cl.
*B41J 2/175* (2006.01)

(52) U.S. Cl. ..... 347/86; 347/85

(58) Field of Classification Search ..... 347/85, 347/86

See application file for complete search history.

(56) References Cited

U.S. PATENT DOCUMENTS

| | | | | |
|---|---|---|---|---|
| 4,599,625 | A * | 7/1986 | Terasawa et al. | 347/87 |
| 4,719,475 | A | 1/1988 | Kiyohara et al. | |
| 5,365,260 | A | 11/1994 | Kitani et al. | |
| 5,754,207 | A | 5/1998 | Gragg et al. | |
| 5,975,686 | A | 11/1999 | Hauck et al. | |
| 6,109,740 | A * | 8/2000 | Namekawa et al. | 347/85 |
| 6,499,838 | B2 * | 12/2002 | Seccombe et al. | 347/85 |
| 2001/0043256 | A1 * | 11/2001 | Seccombe et al. | 347/85 |
| 2002/0057318 | A1 * | 5/2002 | Shyn et al. | 347/86 |
| 2002/0122084 | A1 | 9/2002 | Shihoh et al. | |
| 2003/0117467 | A1 * | 6/2003 | Jung | 347/86 |
| 2003/0122908 | A1 * | 7/2003 | Lin et al. | 347/86 |

FOREIGN PATENT DOCUMENTS

| | | |
|---|---|---|
| DE | 27 15 599 | 10/1978 |
| EP | 0 745 482 A2 | 12/1996 |
| EP | 1 093 922 A1 | 4/2001 |
| EP | 1 256 451 A1 | 11/2002 |
| EP | 1 462 263 A2 | 9/2004 |
| JP | A 57-034967 | 2/1982 |
| JP | A 61-206660 | 9/1986 |
| JP | A 61-233552 | 10/1986 |
| JP | A 62-290544 | 12/1987 |
| JP | U 05-035283 | 12/1993 |
| JP | B2 2942003 | 6/1999 |
| JP | A 2000-006435 | 1/2000 |
| JP | A 2001-162838 | 6/2001 |
| JP | A 2002-248787 | 9/2002 |
| JP | A 2002-264358 | 9/2002 |
| JP | A 2002-361882 | 12/2002 |
| JP | A 2003-136749 | 5/2003 |

* cited by examiner

*Primary Examiner*—Stephen Meier
*Assistant Examiner*—Jason Uhlenhake
(74) *Attorney, Agent, or Firm*—Oliff & Berridge, PLC

(57) ABSTRACT

An ink cartridge being vertically mounted comprises a housing that is provided with an ink discharge port, an ink pack that is disposed within the housing, and a pressing mechanism that presses the ink pack. The pressing mechanism includes a contact and a biasing member. The contact is movably disposed within the housing and in contact with at least a part of the ink pack lower than the ink discharge port. The biasing member biases the contact toward the ink pack in a direction at an angle to a vertical direction.

23 Claims, 10 Drawing Sheets

INK CARTRIDGE AND INK-JET RECORDING APPARATUS USING THE INK CARTRIDGE

BACKGROUND OF THE INVENTION

1. Field of the Invention

The present invention relates to an ink cartridge that stores ink to be supplied to an ink-jet head, and also relates to an ink-jet recording apparatus using the ink cartridge.

2. Description of Related Art

In an ink-jet recording apparatus such as ink-jet is printers, in order to record a good image on a recording medium, it is important that proper meniscus is formed at each nozzle of an ink-jet head. For keeping meniscus of nozzles in a proper condition, pressure applied to the nozzles should be kept within a predetermined range.

When positive pressure or excessively small negative pressure is applied to nozzles, meniscus is broken to cause such a disadvantage as ink dripping from the nozzles. Besides, when excessive negative pressure is applied to nozzles, air bubbles can enter the nozzles to disadvantageously cause ink ejection disability, unstable ejection, and the like. Therefore, pressure to be applied to nozzles has to fall within a predetermined negative range.

Thus, known is a technique of producing negative pressure in nozzles by means of a difference in level between an ink-jet head including nozzles and a cartridge for storing liquid that will be supplied to the head (see U.S. Patent Application Publication No. 2002122084). According to this technique, a cartridge is mounted in a horizontal manner. An upper face of a liquid bag included in the cartridge is fixed to a housing, while a lower face of the liquid bag is freely movable depending on a change in the amount of liquid therein, so that the lower face moves upward when the amount of liquid decreases. As a result, even when the amount of liquid in the liquid bag is changed, pressure applied to nozzles does not vary so much and can be kept within a predetermined range.

SUMMARY OF THE INVENTION

In this technique, however, as a cartridge is horizontally mounted, an area on a horizontal plane occupied by a whole of the cartridge becomes relatively larger. This causes a problem that a recording apparatus increases in size in a horizontal direction.

When a cartridge is vertically mounted, on the other hand, pressure applied to nozzles largely varies depending on a change in the amount of liquid within the liquid bag.

An object of the present invention is to provide an ink cartridge capable of suppressing a variation in pressure applied to nozzles and reducing an area on a horizontal plane occupied by a whole of the cartridge itself, and to provide an ink-jet recording apparatus using the ink-cartridge.

According to a first aspect of the present invention, there is provided an ink cartridge being vertically mounted comprises a housing that is provided with an ink discharge port, an ink pack that is disposed within the housing, and a pressing mechanism that presses the ink pack. The pressing mechanism includes a contact and a biasing member. The contact is movably disposed within the housing and in contact with at least a part of the ink pack lower than the ink discharge port. The biasing member biases the contact toward the ink pack in a direction at an angle to a vertical direction.

According to a second aspect of the present invention, there is provided an ink cartridge comprises a housing, an ink pack that stores ink, and a pressing mechanism th at presses the ink pack. The housing has a plurality of vertical walls each extending in a vertical direction, at least one of the vertical walls being vertically long. The ink pack has an opening for discharging ink and is disposed within the housing. The pressing mechanism includes a contact and a biasing member. The contact is movably disposed within the housing and in contact with a part of the ink pack lower than the opening. The biasing member biases the contact toward the ink pack, and is positioned between the contact and one of the vertical walls of the housing with one end and the other end thereof respectively connected to the contact and the one vertical wall.

With the foregoing first and second aspects, an area on a horizontal plane occupied by the cartridge becomes smaller as compared with either an ink cartridge being horizontally mounted or comprising a housing with no wall vertically long. In addition, since the aforementioned pressing mechanism including the contact and the biasing member is provided, a variation in pressure applied to the nozzles can be suppressed even when the amount of ink within the ink pack is changed.

According to a third aspect of the present invention, there is provided an ink-jet recording apparatus comprising an ink-jet head and an ink cartridge being vertically mounted. The ink-jet head has an ink ejection face in which a plurality of nozzles that eject ink toward a recording medium are formed. The ink cartridge stores ink to be supplied to the ink-jet head. The ink cartridge includes a housing, an ink pack, and a pressing mechanism that presses the ink pack. The housing is provided with an ink discharge port. The ink pack is disposed within the housing. The pressing mechanism includes a contact and a biasing member. The contact is movably disposed within the housing and in contact with at least a part of the ink pack lower than the ink discharge port. The biasing member biases the contact toward the ink pack in a direction at an angle to a vertical direction.

With the foregoing third aspect, since an area on a horizontal plane occupied by the cartridge becomes relatively small, the apparatus as a whole can also be downsized. Moreover, since a variation in pressure applied to the nozzles is suppressed, nozzle meniscus is kept in a proper condition and therefore a good image can be recorded on a recording medium.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, some preferred embodiments of the present invention will be described with reference to the accompanying drawings.

First, referring to FIGS. 1 and 2, a description will be given to an example of an ink-jet printer that adopts an ink cartridge according to a first embodiment of the present invention.

Figure 1:
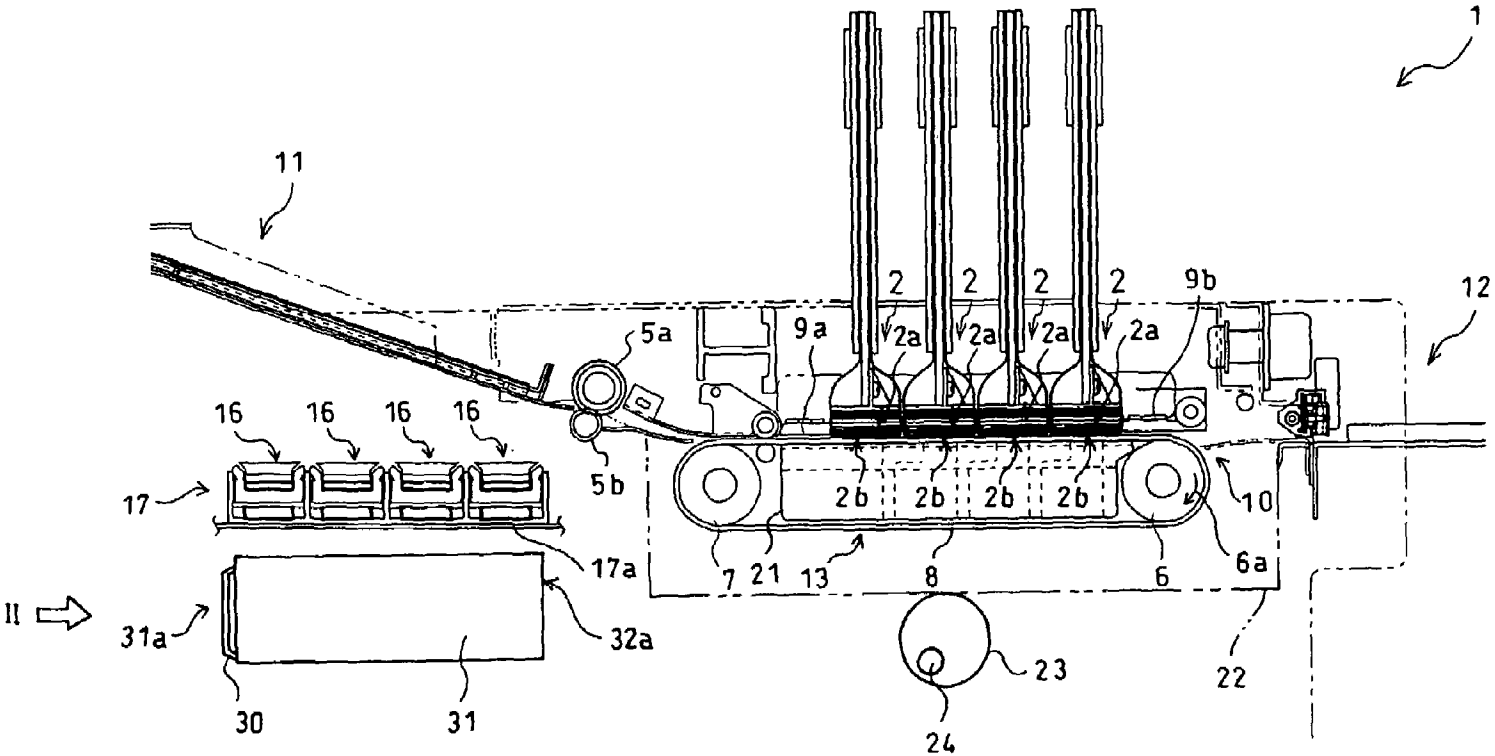
FIG. 1 illustrates a general construction of an exemplified ink-jet printer using an ink cartridge according to a first embodiment of the present invention.

An ink-jet printer 1 illustrated in FIG. 1 is a color printer having four ink-jet heads 2. The printer 1 includes a paper feed unit 11 (as shown lefthand in FIG. 1) and a paper discharge unit 12 (as shown righthand in FIG. 1). Within the printer 1, formed is a paper conveyance path running from the paper feed unit 11 to the paper discharge unit 12.

A pair of paper feed rollers 5*a* and 5*b* are disposed immediately downstream from the paper feed unit 11, so that the rollers 5*a* and 5*b* can pinch a paper as a recording medium which is in this condition conveyed from left to right in FIG. 1. In a middle of the paper conveyance path, a conveyance unit 13 is provided below the four heads 2 so as to confront the four heads 2. The conveyance unit 13 has two rollers 6 and 7, and a looped conveyor belt 8 that is wound on the rollers 6 and 7 to be stretched between them.

The conveyor belt 8 has a two-layered structure made up of a polyester base body impregnated with urethane and a silicone rubber. The silicone rubber is adopted on an outer conveyor face side of the conveyor belt 8. A paper fed through the pair of paper feed rollers 5*a* and 5*b* is pressed on the conveyor face of the conveyor belt 8 to thereby be held onto the conveyor face by adhesive power, and in this condition conveyed downstream, i.e., rightward in FIG. 1 in association with clockwise rotation (rotation in an arrow-6*a* direction) of the one roller 6.

Pressing members 9*a* and 9*b* are provided at positions for feeding a paper onto the conveyor belt 8 and for discharging a paper from the conveyor belt 8, respectively. The pressing members 9*a* and 9*b* serve to press a paper onto the conveyor face in order to prevent a separation of the paper from the conveyor face of the conveyor belt 8. Thereby, the paper can surely be conveyed on the conveyor face.

A peeling plate 10 is provided immediately downstream (rightward in FIG. 1) from the conveyor belt 8. The peeling plate 10 peels off the paper, which is kept on the conveyor face of the conveyor belt 8 by adhesive power, from the conveyor face so that the paper can be transferred toward the paper discharge unit 12.

Each of the four ink-jet heads 2 has, at its lower end, a head main body 2*a*. Each head main body 2*a* has a rectangular section on a plane parallel to a paper conveyance face. The head main bodies 2*a* are arranged close to each other with a longitudinal axis of each head main body 2*a* being perpendicular to a paper conveyance direction, i.e., perpendicular to the drawing sheet of FIG. 1. That is, the printer 1 is of line type. Bottom faces of the respective four head main bodies 2*a* confront the paper conveyance path, and a large number of small-diameter nozzles (not illustrated) are arranged on the bottom faces of the four head main bodies 2*a*. The bottom face of each ink-jet head 2 is hereinafter referred to as an "ink ejection face". From the ink ejection faces of the four head main bodies 2*a*, ejected are magenta ink, yellow ink, cyan ink, and black ink, respectively.

The head main bodies 2*a* are disposed with a narrow clearance being formed between their ink ejection faces and the conveyor face of the conveyor belt 8. The paper conveyance path is formed through this clearance. With this construction, while a paper, which is being conveyed by the conveyor belt 8, passes immediately under the four head main bodies 2*a* in order, the respective color inks are ejected through the corresponding nozzles toward an upper face, i.e., a print face, of the paper to thereby form a desired color image on the paper.

In a region enclosed by the conveyor belt 8, a nearly rectangular parallelepiped guide 21 is arranged at a position opposed to the ink-jet heads 2. The guide 41 is in contact with the back face of the upper part of the conveyor belt 8 to support the upper part of the conveyor belt 8 from inside. The guide 21 has substantially the same width as that of the conveyor belt 8.

The ink-jet printer 1 further comprises a maintenance unit 17 that performs maintenance on the ink-jet heads 2. The maintenance unit 17 includes a frame 17*a*, four purge caps 16, a purge pump (not illustrated), and the like. The frame 17*a* is movable in a horizontal direction. The four purge caps 16 are supported on the frame 17*a*. The purge pump is connected with the respective purge caps 16.

While the ink-jet printer is performing a printing operation, the maintenance unit 17 is disposed in a "withdrawal position", which in this embodiment locates immediately below the paper feed unit 11, where the maintenance unit 17 locates lower than the ink-jet heads and never confronts, in a vertical direction, the ink ejection faces 2*b* of the heads 2. When a predetermined condition is satisfied after completion of the printing operation, the maintenance unit 17 moves in the horizontal direction into a "maintenance position", which is a position where the conveyance unit 13 exist in FIG. 1, where the maintenance unit 17 confronts the ink ejection faces 2*b* of the heads 2 in the vertical direction.

Examples of the predetermined condition include a condition that the printer 1 is kept without any printing operation for a predetermined time period, and a condition that the printer 1 is powered off, etc. When the maintenance unit 17 is in the maintenance position, the purge caps 16 cover the ink ejection faces 2*b* of the respective head main bodies 2*a* to thereby avoid drying of the nozzles.

The conveyance unit 13 is supported on an elevator mechanism including a chassis 22, and movable in the vertical direction by means of the elevator mechanism. The chassis 22 that forms the elevator mechanism is put on a cylindrical member 23 disposed thereunder. The cylindrical member 23 is rotatable around a shaft 24 that is deviated from a center of the cylindrical member 23. Thus, when the shaft 24 rotates, an uppermost level of the cylindrical member 23 varies, and the chassis 22 and the conveyance unit 13 accordingly move up and down.

Before the maintenance unit 17 starts moving from the "withdrawal position" into the "maintenance position" as described above, the cylindrical member 23 is rotated through an appropriate angle so that the conveyance unit 13 is, together with the chassis 22, moved down to an appropriate extent from the position as it is shown in FIG. 1. This can provide a space required for a movement of the maintenance unit 17.

Below the maintenance unit 17, a mounting station 31*a* is provided to hold four ink cartridges 31 (see FIG. 2) being vertically mounted. In the mounting station 31*a*, the four ink cartridges 31 are arranged in parallel with one another in the direction perpendicular to the drawing sheet of FIG. 1

Figure 2:
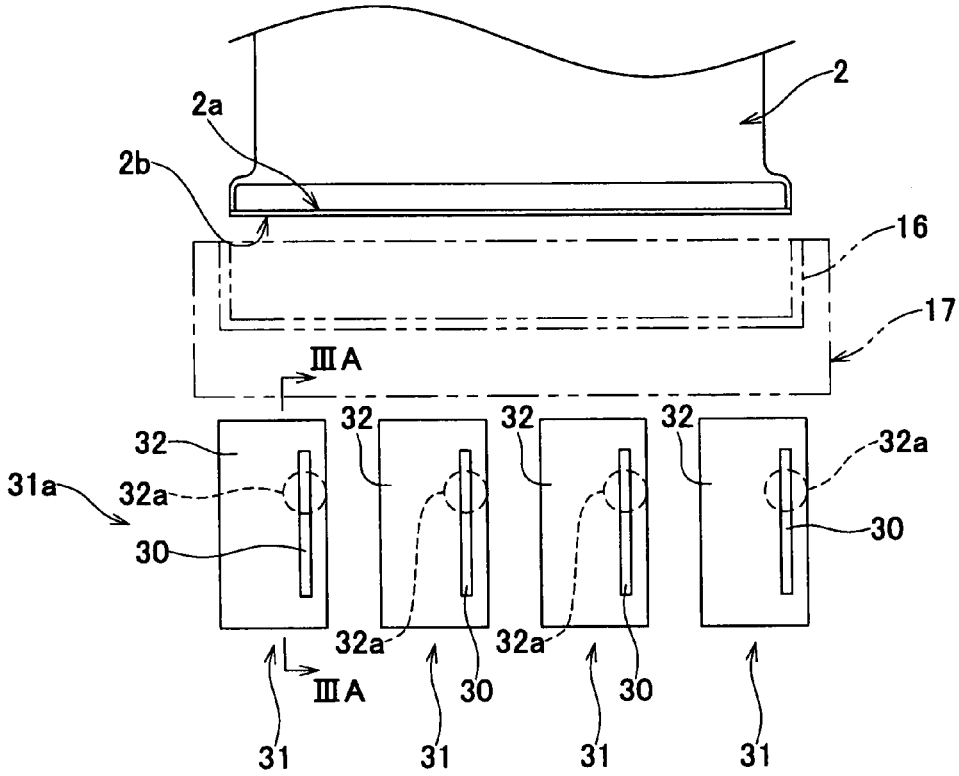
FIG. 2 schematically illustrates a state where a maintenance operation is performed on a head in the printer of FIG. 1 as seen from an arrow-II direction.

Each ink cartridge 31 is detachable from the printer 1 in the paper conveyance direction, i.e., in the direction perpendicular to the drawing sheet of FIG. 2. More specifically, each ink cartridge 31 gets mounted on the mounting station 31*a* in an arrow-II direction of FIG. 1, headed by its front face having an ink discharge port 32*a*. When the ink cartridge 31 is pulled out in a direction reverse to the arrow II, the ink cartridge 31 can be detached from the mounting station 3*a*.

A handle 30 is formed on a rear face of each ink cartridge 31, i.e., on a face shown in FIG. 2 which is a left-side face in FIG. 1. Therefore, for attaching and detaching the ink cartridge 31 to and from the mounting station 31*a*, a user can easily perform the operation by gripping the handle 30.

Each ink cartridge 31 has a housing 32 made of a synthetic resin, and an ink pack 33 (see FIGS. 3A, 3B, and 3C) disposed within the housing 32 to store ink that is to be supplied to the head 2. The four ink cartridges 31 are connected with the respective heads 2 by flexible tubes (not illustrated), so that ink contained in the ink packs 33 can be supplied to the respective heads 2.

Due to a difference in level between the heads 2 and the ink cartridges 31 as illustrated in FIG. 2, the heads 2 receive negative pressure immediately after ink is ejected from the ink ejection faces 2*b* of the heads 2. This negative pressure and capillarity of the nozzles cause suction force that sucks the ink contained in the ink packs 33 into the heads 2.

Then, referring to FIGS. 3A, 3B, 3C, 4A, and 4B, the ink cartridges 31 are described in more detail.

Figure 3A:
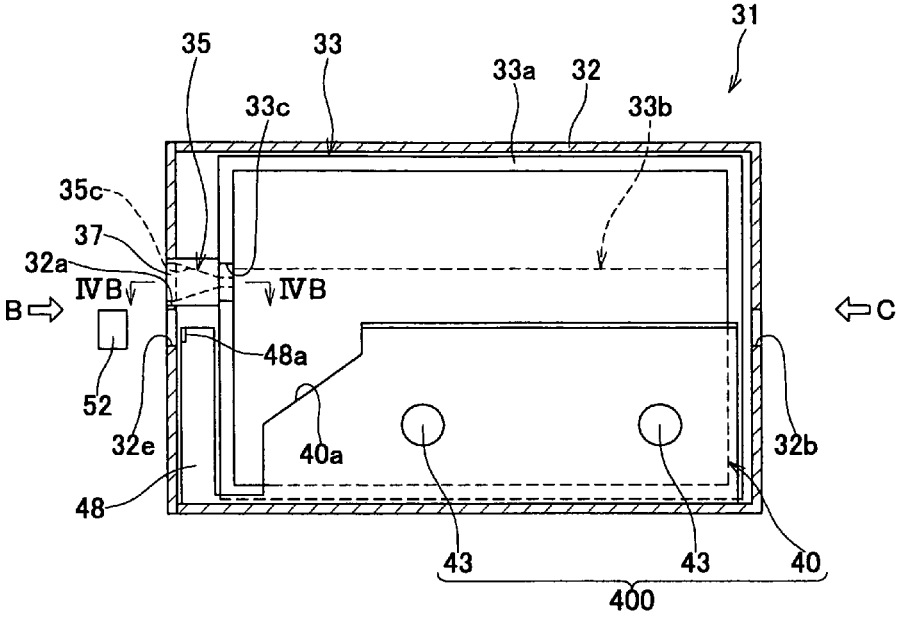
FIG. 3A is a sectional view of the ink cartridge taken along a line IIIA—IIIA of FIG. 2.

As illustrated in FIG. 3A, the ink cartridge 31 comprises, within the housing 32, not only the ink pack 33 but also a pressing mechanism 400 having a contact 40 and coiled springs 43. The coiled springs 43 serve to bias the contact 40 toward the ink pack 33. An arrow P of FIGS. 3B and 3C indicates a direction where the pressing mechanism 400 presses the ink pack 33.

Figure 3B:
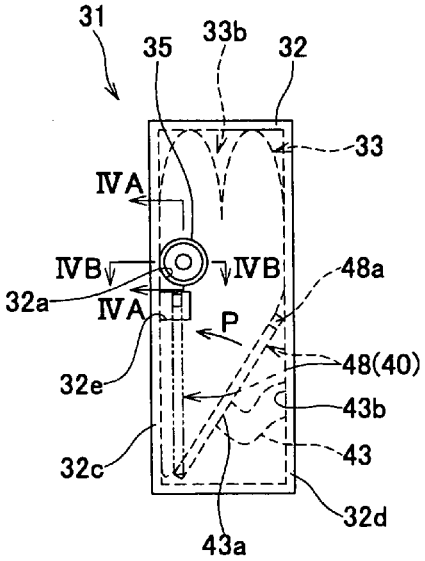
FIG. 3B is a front vies of the ink cartridge as seen from an arrow-B direction of FIG. 3A.
Figure 3C:
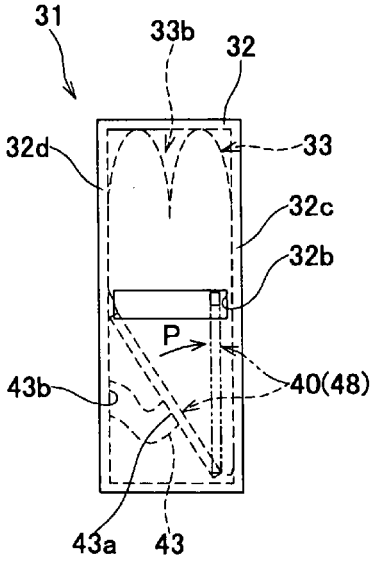
FIG. 3C is a rear view of the ink cartridge as seen in an arrow-C direction of FIG. 3A.

The housing 32 is, as illustrated in FIGS. 3B and 3C, a substantially parallelepiped hollow member with its vertical length longer than its horizontal width, i.e., than its side extending along a direction perpendicular to the drawing sheet of FIG. 3A. When the ink cartridge 31 is mounted on the mounting station 31*a*, the housing 32 is fixed in a predetermined position by means of an appropriate support member (not illustrated) within the printer 1.

An ink discharge port 32*a* is formed in a front face (i.e., a left-side face in FIG. 3A) of the housing 32. The ink discharge port 32*a* is, as illustrated in FIG. 3B, formed at a position slightly above a vertical center and deviated from a widthwise center toward a sidewall 32*c* of the housing 32, toward which the pressing mechanism 400 presses the ink pack 33. More specifically, the ink discharge port 32*a* is disposed slightly above a portion where an upper end of the contact 40 is positioned after completion of pressing against the ink pack 33.

The ink pack 33 stores ink under a deaerated state. As illustrated in FIG. 3A, one end of a spout 35 made of a resin is connected to an opening 33*c* of the ink pack 33, so that ink contained in the ink pack 33 is discharged out of the housing 32 via the spout 35.

Figure 4A:
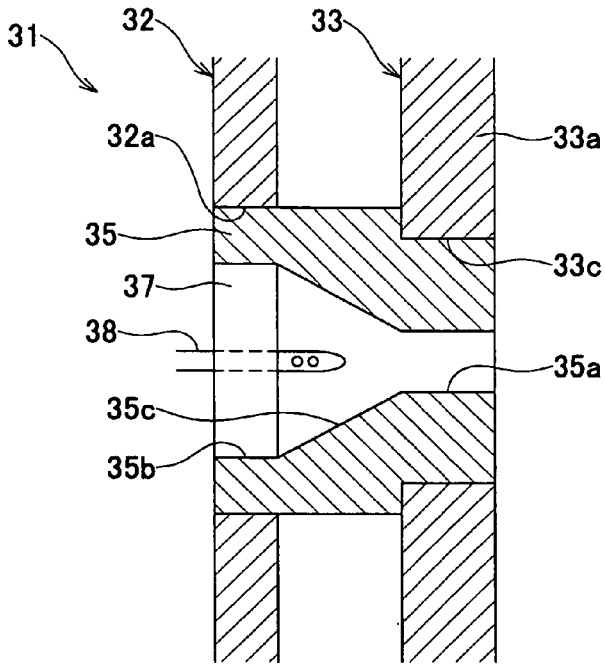
FIG. 4A is a local sectional view taken along a line IVA—IVA of FIG. 3B.
Figure 4B:
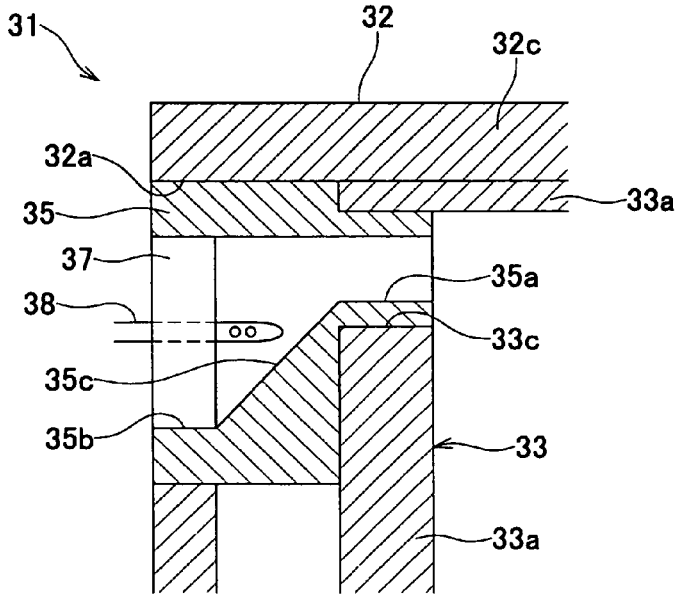
FIG. 4B is a local sectional view taken along a line IVB—IVB of FIGS. 3A and 3B, FIGS. 5A and 53 are schematic sectional views showing how a contact and a coiled spring act depending on the amount of ink in an ink pack in the ink cartridge.

As illustrated in FIGS. 4A and 4B, the spout 35, which is fitted into the ink discharge port 32*a* of the housing 32, has one end connected with the opening 33*c* of the ink pack 33 and the other end facing an outside of the housing 32. In the spout 35, formed is a through-hole 35*c* extending from the one end to the other end. An opening 35*a* formed at one end of the through-hole 35*c* is smaller than an opening 35*b* formed at the other end of the through-hole 35*c*. In addition, as illustrated in FIG. 4B, the opening 35*a* at one end is, in comparison with the opening 35*b* at the other end, more deviated toward one sidewall 32*c* of the housing 32, toward which the pressing mechanism 400 presses the ink pack 33.

A cap 37 made of a silicone rubber or a butyl rubber is fitted into the opening 35*b* of the spout 35, and a hollow needle 38 penetrates through the cap 37. The hollow needle 38 is provided at an end portion of a flexible tube (not illustrated) that is connected with each of the heads 2. Thus, ink contained in the ink pack 33 is introduced through the hollow needle 38 into the flexible tube, and then supplied to each head 2.

A replacement of the ink cartridge 31 may be implemented by pulling the hollow needle 38 away from the cap 37 of the waste ink cartridge and then penetrating the hollow needle 38 into a cap 37 of a new ink cartridge.

The ink pack 33 is made of a resin film that has been formed by laminating a plurality of flexible films by means of thermo-compression bonding, etc. More specifically, the ink pack 33 has a layered structure made up of an innermost polypropylene layer, a polyester layer acting as a base material, an alumina or silica vapor-deposition layer having a gas barrier function, and a nylon layer for strength improvement, in this sequence from inside to outside.

As illustrated in FIG. 3A, a seal portion 33*a* is provided on an outer surface of the ink pack 33. The seal portion 33*a* is made of two resin films that are bonded to each other by thermo-compression bonding. By, simultaneously with providing the seal portion 33*a*, bonding one end of the spout 35 to the ink pack 33 by thermo-compression bonding, ink leakage through the opening 33*c* of the ink pack 33 can surely be prevented.

On a top face of the ink pack 33, a fold 33*b* is formed along a direction of attachment and detachment of the cartridge (i.e., a right-to-left direction in FIG. 3A or a direction perpendicular to the drawing sheet of FIGS. 3B and 3C). The fold 33*b* is formed by tucking down a center of the top face of the ink pack 33. Under a full-ink condition as shown in FIGS. 3B and 3C, an upper part of the ink pack 33 forms two angular portions. With such a fold formed in the ink pack 33, the amount of ink charged in the ink pack 33 can be increased. It is hard to charge ink up to the upper part of the ink pack 33 because of the gravity. In this embodiment, however, the fold 33 formed on the top face of the ink pack 33 allows the ink pack 33 to expand throughout both upper corners of the housing 32 so that ink can efficiently charged within the ink pack 33.

The contact 40 is a plate-like member whose lower end is fixed at a position on a bottom face of the housing 32 deviated toward the sidewall 32*c*, as shown in FIGS. 3B and 3C. The contact 40 is rotatable around the lower end thereof. A notch 40*a* is formed at a portion of the contact 40 near to the ink discharge port 32*a* (see FIG. 3A).

One ends of the respective two coiled springs 43 are connected to a face of the contact 40 opposite to a face thereof contacting with the ink pack 33. The other ends of the respective coiled springs 43 are connected to a sidewall 32*d* standing opposite to the sidewall 32*c* of the housing 32. One ends 43*a* of the respective coiled springs 43 are disposed lower than the other ends 43*b* thereof, and therefore the coiled springs 43 can easily be buckled.

Within the housing 32, an interlocker 48 that interlocks with the contact 40 is disposed below the spout 35 and in front of the contact 40 (i.e., on a left side of the contact 40 in FIG. 3A) The interlocker 48 is a plate-like member, and the interlocker 48 and the contact 40 are always on the same plane. Similarly to the contact 40, the interlocker 48 has its lower end fixed at a position on the bottom face of the housing 32 deviated toward the sidewall 32*c*, and is rotatable around its lower end.

The interlocker 48 is formed integrally with the contact 40 by notching the plate-like member. This enables the interlocker 48 to be efficiently formed without increasing the number of parts. A detection target 48*a* is provided at an upper end of a front face (i.e., on a left side in FIG. 3A) of the interlocker 48. A substantially square-shaped first detection window 32*e* is formed immediately below the ink discharge port 32*a* of the housing 32. In addition, a reflective photosensor 52 is positioned outside the housing 32 such that it can confront the first detection window 32*e* and such that it can confront the detection target 48*a* under the condition after completion of pressing against the ink pack 33. The sensor 52 is positioned to confront the front face in which the ink discharge port 32*a* is formed (i.e., positioned on a right side of the cartridge 31 in FIG. 1), in order to avoid interfering with an attachment and detachment of the cartridge.

Here, referring to FIGS. 5A and 5B, a description will be given to how the contact 40 and the coiled springs 43 of the pressing mechanism 400 operate depending on an amount of ink contained in the ink pack 33.

Figure 5A:
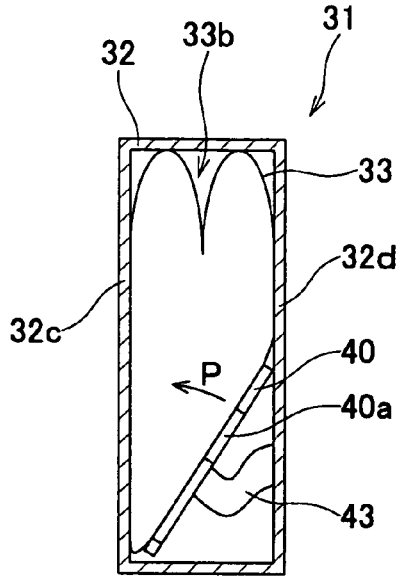

As illustrated in FIG. 5A, when ink is unused, i.e., the ink pack 33 is filled with ink, the coiled springs 43 are in a buckling state. At this time, the contact 40 is laid in an inclining manner while pressing a lower portion of the ink pack 33 with relatively small force by biasing force of the coiled springs 43.

As a printing operation progresses, an amount of ink in the ink pack 33 decreases by degrees. In association with this, the contact 40 presses the lower portion of the ink pack 33 while rotating around its lower end by biasing force of the coiled springs 43. When the contact 40 comes into such a position that the coiled springs 43 become unbuckled, biasing force intrinsic in the coiled springs 43 enables the contact 40 to press the ink pack 33 with larger force.

Since the contact 40 presses the lower portion of the ink pack 33 in association with its rotation, the ink within the ink pack 33 is gradually gathered upward. The ink gathered in an upper portion of the ink pack 33 is gradually discharged through the spout 35 into the corresponding head 2 by means of suction force that is caused by negative pressure applied to the nozzles of the head 2 and capillarity of the nozzles.

Moreover, the ink within the ink pack 33 incurs fluid pressure whose intensity depends upon pressing force applied by the contact 40 and the coiled springs 43. On the other hand, pressure applied to the nozzles of the head 2 depends mainly upon the fluid pressure arising in the ink within the ink pack 33 and upon a difference in level between the head 2 and the ink cartridge 31. Accordingly, pressing force applied by the contact 40 and the coiled springs 43 is adjusted in consideration of the difference in level between the head 2 and the ink cartridge 31, so that pressure to be applied to the nozzles can be kept within a predetermined negative range, −20 $mmH_2O$ to −80 $mmH_2O$ in this embodiment, This can suppress such a disadvantage as ink dripping due to broken meniscus which is often caused when positive pressure or excessively small negative pressure, e.g., −10 $mmH_2O$, is applied to the nozzles, and moreover this can suppress disadvantages such as ink ejection disability and unstable ink ejection due to air bubbles entering the nozzles which is often caused when excessive negative pressure, e.g., −100 $mmH_2O$, is applied to the nozzles.

Figure 5B:
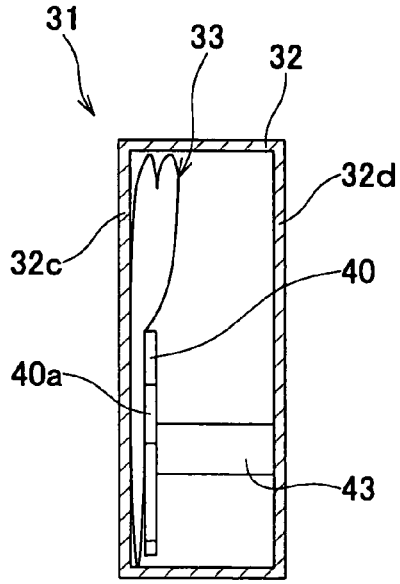

As illustrated in FIG. 5B, when the coiled springs 43 expand in the horizontal direction, the contact 40 stops in a vertically standing state and completes its pressing against the ink pack 33. In this embodiment, the coiled springs 43 have such spring characteristics that the amount of ink within the ink pack 33 can reach approximately zero when the contact 40 reaches a rotation limit as shown in FIG. 5B, i.e., upon completion of the pressing.

Upon completion of pressing against the ink pack 33, the sensor 52 detects the detection target 48*a*. This indicates to a user that the pressing against the ink pack 33 has completed. In addition, as described above, since the amount of ink within the ink pack 33 is adjusted such that it can reach approximately zero upon completion of the pressing, the user also recognizes that the amount of ink reaches zero at this time.

Although the interlocker 48 rotates together with the contact 40, the interlocker 48 is away from the ink pack 33 while the contact 40 is pressing the ink pack 33 by biasing force of the coiled springs 43. Therefore, since the interlocker 48 is prevented from contacting with the ink pack 33 and thus from interfering with the pressing operation, pressing against the ink pack 33 can smoothly be performed and, at the same time, completion of pressing can exactly be detected.

Moreover, by detecting a position of the detection target 48*a*, the amount of ink within the ink pack 33 can be recognized. Since, in this embodiment, the detection target 48*a* is positioned away from a center of rotation of the interlocker 48, the detection target 48*a* moves to a larger extent while the ink pack 33 changes from a full-ink state to an approximately zero-ink state. This enables the amount of ink to be detected with improved accuracy.

As illustrated in FIGS. 3A and 3C, a second detection window 32*b* is formed in a rear face of the housing 32 (i.e., in a right-side face in FIG. 3A). The second detection window 32*b* is longer in a transverse direction than the first detection window 32*e*, and formed across a substantially entire width of the housing 32. An upper end portion of the interlocker 48 appears in the first detection window 32*e* only around the time of completion of the pressing against the ink pack 33, while a part of the upper end of the contact 40 always appears in the second detection window 32*b*. As illustrated in FIG. 1, when the ink cartridges 31 are mounted on the mounting station 31*a*, the rear faces of the respective cartridges 31 are exposed to an outside of the printer 1 and therefore an user can readily make visual observation thereof. Therefore, instead of any special detection means such as sensors, the user can visually observe the contact 40 from the outside through the second detection window 32*b*, and recognize a position of the contact 40, which indicates to the user not only whether pressing is completed but also a rough amount of ink remaining within the ink pack 33. In addition, when a scale that indicates the amount of ink is marked at the upper end portion of the rear face of the contact 40, the amount of ink can be recognized more exactly.

According to the ink cartridge 31 of this embodiment, as described above, an area on a horizontal plane occupied by the cartridge 31 becomes smaller as compared with an ink cartridge being horizontally mounted or comprising a housing with no wall vertically long. Moreover, since the above-described pressing mechanism 400 including the contact 40 and the coiled springs 43 is provided, a variation in pressure applied to the nozzles can be suppressed even when the amount of ink within the ink pack 33 is changed.

According to the printer 1 using the ink cartridge 31 of this embodiment, further, since the area on the horizontal plane occupied by the cartridge 31 becomes relatively small, the printer 1 as a whole can also be downsized. In addition, since a variation in pressure applied to the nozzles is suppressed, nozzle meniscus is kept in a proper condition and therefore stable ejection characteristics can be obtained. Consequently, a good image can be recorded on a paper.

The pressing force applied by the contact 40 and the coiled springs 43 is adjusted in consideration of the difference in level between the head 2 and the ink cartridge 31, so that pressure to be applied to the nozzles can be set at a predetermined value. This can provide an improved variance in design of how to arrange the head 2 and the ink cartridges 31. For example, there can be adopted such a layout that, as in this embodiment, the mounting station 31*a* for the ink cartridges 31 locates below the withdrawal position in order to provide the withdrawal position of the maintenance unit 17.

The contact 40 of this embodiment is rotatable around its lower end. Therefore, appropriate pressing force can be applied to the ink pack 33 depending on the amount of ink within the ink pack 33, so that the variation in pressure applied to the nozzles can effectively be restrained.

Furthermore, the coiled springs 43 stay buckled when ink is unused. Accordingly, when the ink pack 33 is filled with ink and therefore internal pressure, i.e., ink discharge pressure through the ink discharge port 32*a*, is sufficiently high, the pressing force applied to the ink pack 33 can be kept small. Then, as the ink within the ink pack 33 decreases to lower the internal pressure of the ink pack 33, the pressing force applied to the ink pack 33 can be increased. Like this, by varying the pressing force in accordance with a change in amount of ink within the ink pack 33, the pressure applied to the nozzles can always be kept within a predetermined range. Moreover, when there is a large amount of ink within the ink pack 33, no excessive pressing force is applied to the ink pack 33. As a result, a larger amount of ink can be charged into the ink pack 33.

Since the ink discharge port 32*a* is disposed near a portion where the upper end of the contact 40 is positioned after completion of pressing against the ink pack 33, the ink within the ink pack 33 can, in association with the pressing, smoothly be flown into the ink discharge port 32*a* and discharged therefrom. This can economically reduce an amount of ink unusedly remaining within the ink pack 33.

The position of the ink discharge port 32*a* deviated toward the sidewall 32*c*, toward which the pressing mechanism 400 presses the ink pack 33, can also provide the aforementioned effect, i.e., the effect that the ink within the ink pack 33 can smoothly be discharged from the ink discharge port 32*a*.

In this embodiment, particularly, the housing 32 forms a rectangular cylinder, the contact 40 presses the ink pack 33 while moving toward the sidewall 32*c* of the housing 32 by biasing force of the coiled springs 43, and the ink discharge port 32*a* is provided to be deviated toward the sidewall 32*c*. With this construction, the pressing against the ink pack 33 can be performed efficiently because the ink pack 33 is sandwiched between the contact 40 and the sidewall 32*c* of the housing 32, and at the same time the ink within the ink pack 33 can smoothly be discharged from the ink discharge port 32*a*. This can provide the same effect as mentioned above that a reduced amount of ink remains within the ink pack 33.

The notch 40*a* is formed at a portion of the contact 40 near to the ink discharge port 32*a*. If a contact having no notch 40*a* were used to press the ink pack 33, its portion corresponding to the notch 40*a* would interfere with inkflow that runs toward the ink discharge port 32*a* and thus ink could not be discharged smoothly. In this embodiment, on the contrary, since the notch 40*a* is formed, ink flowing toward the ink discharge port 32*a* has its passage resistance restrained and the ink can smoothly flow toward the ink discharge port 32*a* to be discharged therefrom. Therefore, the presence of the notch 40*a* can also provide the same effect as mentioned above that a reduced amount of ink remains within the ink pack 33.

In this embodiment, further, the spout 35 is connected to the ink discharge port 32*a*, and the opening 35*a* formed at one end of the spout 35 connected with the opening 33*c* of the ink pack 33 is more deviated toward the sidewall 32*c*, toward which the pressing mechanism 400 presses the ink pack 33, as compared with the opening 35*b* formed at the other end of the spout 35. Since, like this, the opening 35*a* at one end connected with the opening 33*c* of the ink pack 33 is deviated toward the sidewall 32*c*, ink can smoothly flow from the opening 33*c* of the ink pack 33 to the opening 35*a* of the spout 35. The ink is then discharged through the through-hole 35*c* of the spout 35 into the outside of the housing 32. This can provide the effect that a reduced amount of ink remains within the ink pack 33.

Next, with reference to FIGS. 6, 7, 8A, 8B, and 8C, a description will be given to modifications of a means for detecting completion of pressing against the ink pack 33. Here, the same members as in the above-described embodiment will be denoted by the common reference numerals, and descriptions thereof will be omitted.

Figure 6:
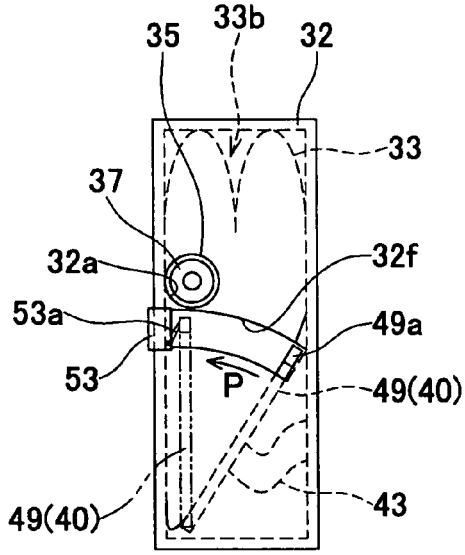
FIG. 6 is a front view similar to FIG. 3B, and shows a first modification of a means for detecting completion of pressing against the ink pack.

A first modification as illustrated in FIG. 6 differs from the first embodiment in constructions of an interlocker and a first detection window. No detection target 48*a* is provided at an upper end of an interlocker 49, but a protrusion 49*a* protruding toward a front side (vertically upward from the drawing sheet of FIG. 6) is formed. A first detection window 32*f* is longer in a transverse direction than the detection window 32*e* of FIG. 3B, and shaped in conformity with a track on which an upper end portion of the interlocker 49 travels during its rotation, so that the protrusion 49*a* of the interlocker 49 can always protrude beyond the detection window 32*f*. A leaf switch 53 is disposed at an end of the detection window 32*f* on the pressing direction P side, i.e., disposed at a position into which the upper end of the interlocker 49 comes when pressing is completed.

Upon completion of pressing against an ink pack 33, the protrusion 49*a* of the interlocker 49 comes in contact with a lever 53*a* of the leaf switch 53 to thereby operate the leaf switch 53. This informs a user of completion of pressing against the ink pack 33.

In this modification, differently from the detection window 32*e* of the first embodiment, the first detection window 32*f* formed in a front face of the housing 32 has such a configuration that the protrusion 49*a* of the interlocker 49 can always protrude beyond the first detection window 32*f*. Accordingly, instead of any special detection means such as sensors, an user can visually observe the protrusion 49*a* of the interlocker 49 from the outside through the first detection window 32*f*, and thereby recognize a position of the contact 40, which indicates to the user not only whether pressing against the ink pack 33 is completed but also a rough amount of ink remaining within the ink pack 33.

Figure 7:
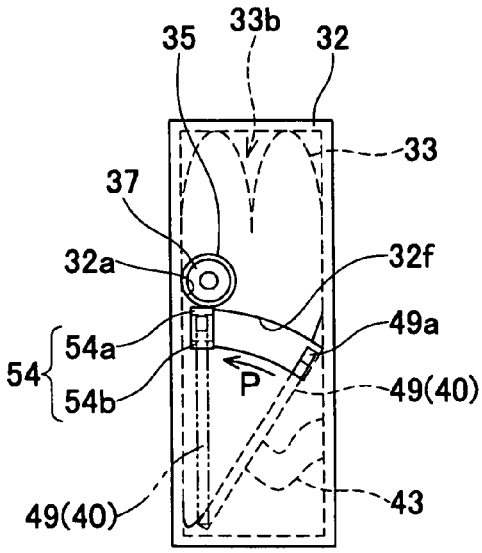
FIG. 7 is a front view similar to FIG. 3B, and shows a second modification of the means for detecting completion of pressing against the ink pack.

A second modification as illustrated in FIG. 7 is almost the same as the first modification of FIG. 6, but detects a protrusion 49*a* by means of, instead of the leaf switch 53, a transmissive photosensor 54. Upon completion of pressing against an ink pack 33, the protrusion 49*a* comes between an upper detector 54*a* and a lower detector 54*b* of the transmissive photosensor 54 and is detected in this state. This informs a user of completion of pressing against the ink pack 33.

Figure 8A:
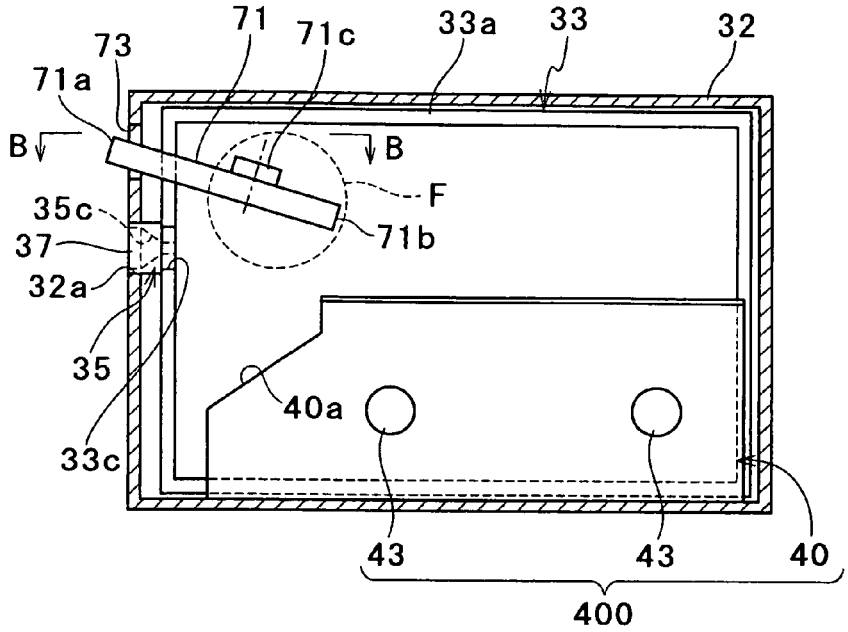
FIG. 8A is a sectional view similar to FIG. 3A, and shows a third modification of the means for detecting completion of pressing against the ink pack.
Figure 8B:
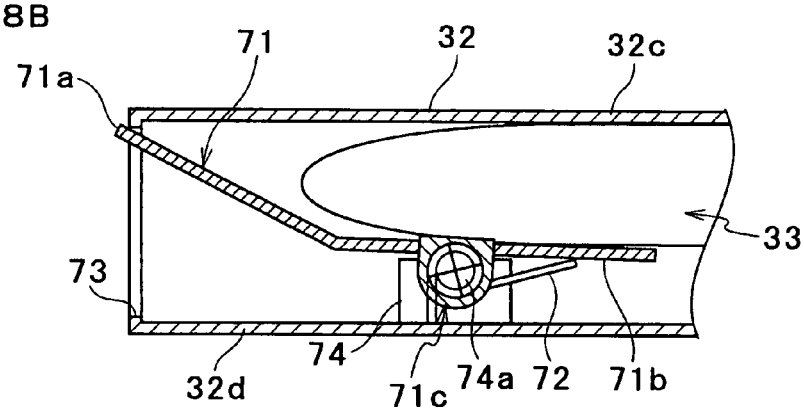
FIG. 8B is a sectional view taken along a line B—B of FIG. 8A, and shows a state where an F part of FIG. 8A is filled up with ink.
Figure 8C:
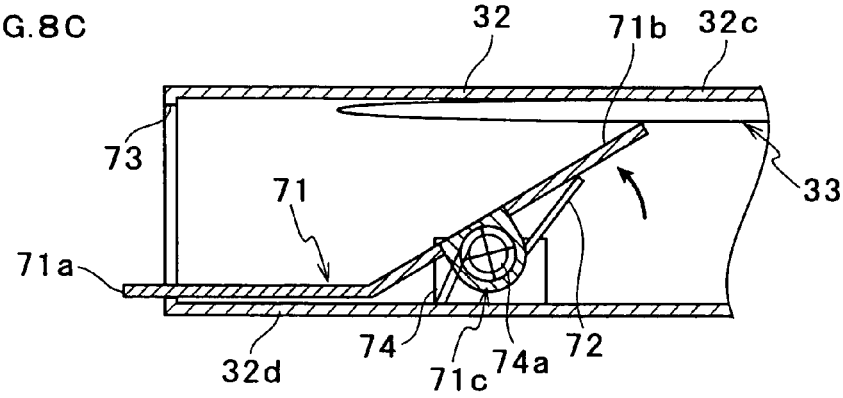
FIG. 8C is a sectional view taken along the line B—B of FIG. 8A, and shows a state where the F part of FIG. 8A deflates.

In a third modification illustrated in FIGS. 8A to 8C, an ink amount detector 71 is further included in the housing 32. The ink amount detector 71 and the contact 40 are separate members, and the ink amount detector 71 displaces in accordance with an amount of ink within an ink pack 33. The ink amount detector 71 is, as illustrated in FIG. 8A, disposed above a notch 40*a* of the contact 40 in such a manner as to incline upward toward a front side.

As illustrated in FIGS. 8B and 8C, the ink amount detector 71 is, in a plan view, an elongated plate-like member bent into V-shape. The ink amount detector 71 is rotatable around a shaft 74*a*. A rotation supporter 74 is secured to a sidewall 32*d* of the housing 32, and the shaft 74*a* is mounted on the rotation supporter 74. On a side of the bent portion of the ink amount detector 71 slightly near to its rear end 71*b*, integrally formed is a bracket 71*c* that is rotatably supported on the shaft 74*a*.

A coiled spring 72 is wound around a circumference of the shaft 74*a*. One end of the coiled spring 72 is in contact with the sidewall 32*d* of the housing 32, and the other end thereof is in contact with a vicinity of the rear end 71*b* of the ink amount detector 71. Thus, the coiled spring 72 biases the vicinity of the rear end 71*b* of the ink amount detector 71 toward the ink pack 33 side by use of reaction force received from the sidewall 32*d* of the housing 32. As a result, the vicinity of the rear end 71*b* of the ink amount detector 71 can always be in contact with a side face of the ink pack 33 near to an ink discharge port 32*a*.

As illustrated in FIG. 8A, the housing 32 has an opening 73 formed above the ink discharge port 32*a*. A front end 71*a* of the ink amount detector 71 protrudes beyond the opening 73. As illustrated in FIGS. 8B and 8C, the opening 73 is formed across a substantially entire width of the housing 32, and has an elongated shape with its length corresponding to a range within which the front end 71*a* of the ink amount detector 71 travels during its rotation. Therefore, the front end 71*a* of the ink amount detector 71 always protrudes beyond the opening 73.

Here will be explained how the pressing mechanism 400 and the ink amount detector 71 operate in accordance with the amount of ink within the ink pack 33.

In the above-described first embodiment, spring characteristics of the coiled springs 43 are adjusted such that the amount of ink within the ink pack 33 can reach approximately zero upon completion of pressing by the pressing mechanism 400. In this modification, alternatively, spring characteristics of the coiled springs 43 are adjusted such that the pressing mechanism 400 can complete its pressing operation before the amount of ink within the ink pack 33 reaches approximately zero.

When the contact 40 rotates halfway and a certain amount of ink remains within the ink pack 33, a portion of the ink pack 33 enclosed with a dotted line in FIG. 8A (hereinafter referred to as an "F portion") is kept filled up with ink. This is because, as mentioned above, the ink within the ink pack 33 is, in association with rotation of the contact 40 having the notch 40*a*, gathered upward especially around the ink discharge port 32*a*. FIG. 8B illustrates this state.

Subsequently, when the contact 40 rotates on up to its rotation limit and completes pressing against the ink pack 33, most of the ink within the ink pack 33 is gathered around the F portion. The ink gathered around the F portion is discharged through the ink discharge port 32*a*, and the F portion accordingly becomes deflated by degrees. In association with this, biasing force of the coiled spring 72 forces the ink amount detector 71 to rotate counterclockwise in a plan view, so that the front end 71*a* moves from its position shown in FIG. 8B into a position shown in FIG. 8C.

According to this modification, as described above, since the front end 71*a* protrudes beyond the opening 73, completion of pressing can easily be detected by employing, e.g., the leaf switch of FIG. 6 and the transmissive photosensor 54 of FIG. 7.

Moreover, by detecting a position of the front end 71*a*, the amount of ink within the ink pack 33 can be recognized. A desired detection accuracy can be obtained by properly sharing a whole length of the ink amount detector 71 between a distance from a center of rotation to the front end 71*a* and a distance from the center to the rear end 71*b*.

Further, since the ink amount detector 71 and the contact 40 are separated members that are independent of each other, spring characteristics of the coiled springs 43 can be adjusted with an improved variance as compared with the above-described first embodiment. In the first embodiment, the amount of residual ink is detectable based on the positions of the contact 40 and the interlocker 48. Therefore, spring characteristics of the coiled springs have to be adjusted such that the positions of the contact 40 and the interlocker 48 can correspond to the amount of residual ink. In this modification, on the other hand, the amount of residual ink is detectable based on the position of the ink amount detector 71 that is a separated member from the contact 40. Therefore, spring characteristics of the coiled springs 43 for biasing the contact 40 can properly be adjusted. Consequently, spring characteristics of the coiled springs 43 can be increased to a proper extent, for stabilization of pressing force by the pressing mechanism 400.

In this modification, since completion of pressing against the ink pack 33 and/or the amount of ink within the ink pack 33 are detected based on the ink amount detector 71, there is no need of the interlocker 48 and the first detection window 32*e* of the first embodiment, which are therefore omitted from FIGS. 8A to 8C.

Next, referring to FIGS. 9A, 9B, 9C, and 9D, a description will be given to an ink cartridge according to a second embodiment of the present invention. Here, the same members as in the above-described embodiment will be denoted by the common reference numerals, and descriptions thereof will be omitted.

Figure 9A:
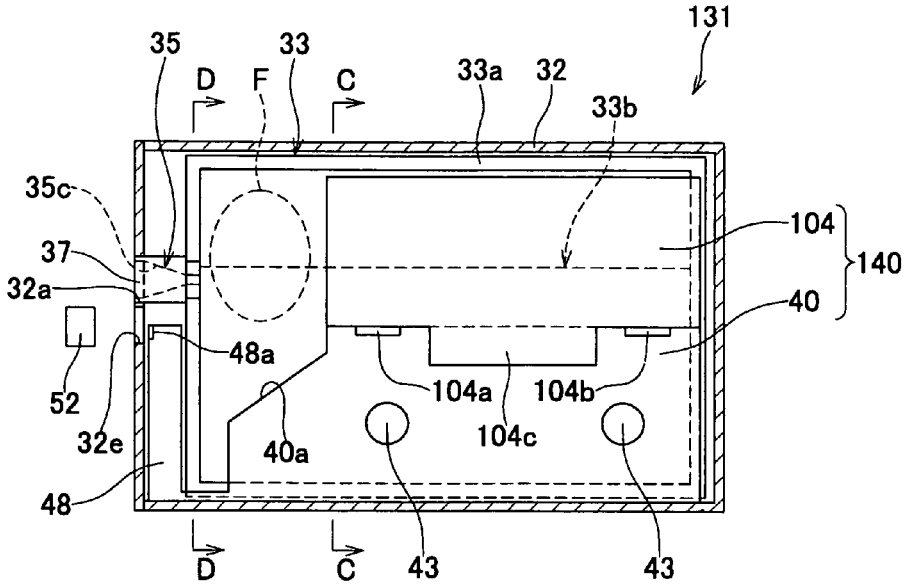
FIG. 9A is a sectional view similar to FIG. 3A, and shows an ink cartridge according to a second embodiment of the present invention.

As seen from FIGS. 9A and 3A, an ink cartridge 131 of this embodiment comprises a contact 140 that is different from the contact of the first embodiment. The other members are the same as in the first embodiment, so the ink cartridge 131 is also applicable to the ink-jet printer 1.

The contact 140 has an upper contact portion 104 and a lower contact portion 40. The upper contact portion 104 and the lower contact portion 40 contact with an upper part and a lower part of an ink pack 33, and, by biasing force of the coiled springs 43, press the upper and lower part of the ink pack 33, respectively.

The lower contact portion 40 has substantially the same construction as that of the contact of the first embodiment. That is, the lower contact portion 40 is a plate-like member whose lower end is fixed at a position on a bottom face of a housing 32 deviated toward the sidewall 32*c* (see FIG. 3B). The lower contact portion 40 is rotatable around the lower end thereof, and biased toward the ink pack 33 by the coiled springs 43.

The upper contact portion 104 is, as illustrated in FIG. 9A, a rectangular plate-like member whose length is substantially the same as an upper edge of the lower contact portion 40. The upper contact portion 104 is connected to the upper edge of the lower contact portion 40, via two cylindrical rollers 104*a* and 104*b*, at a variable angle to the lower contact portion 40. In the middle of a lower edge of the upper contact portion 104, a protrusion 104*c* protruding downward is formed between the rollers 104*a* and 104*b*.

Here will be described how the contact 140 operates in accordance with the amount of ink within the ink pack 33.

Figure 9B:
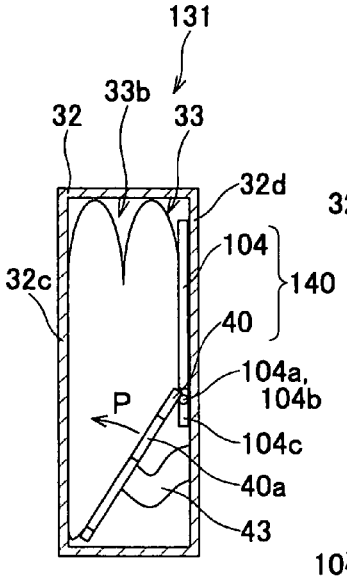
FIG. 9B is a schematic sectional view showing a state where an ink pack is filled up with ink.

When the ink pack 33 is filled up with ink, the lower contact portion 40 is laid in an inclining manner, and the upper contact portion 104 is laid along the vertical direction and sandwiched between the ink pack 33 and a sidewall 32*d* of the housing 32, as illustrated in FIG. 9B.

As the amount of ink within the ink pack 33 decreases by degrees, the lower contact portion 40 rotates around its lower end in the pressing direction P. On the other hand, the upper contact portion 104 is kept standing vertically.

Figure 9C:
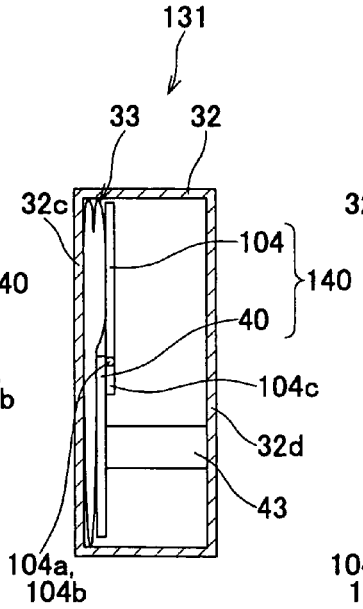
FIGS. 9C and 9D are sectional views taken along lines C—C and D—D of FIG. 9A, respectively, and show states of completion of pressing.
Figure 9D:
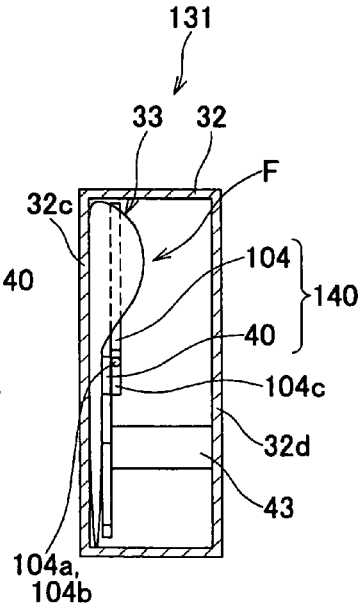

Then, as illustrated in FIG. 9C, the coiled springs 43 expand in the horizontal direction, and the lower contact portion 40 stands in the vertical direction. Simultaneously, the protrusion 104*c* of the upper contact portion 104 is brought into contact with a surface of the lower contact portion 40, so that both the upper contact portion 104 and the lower contact portion 40 press the ink pack 33 in a vertically standing manner by biasing force of the coiled springs 43. The upper contact portion 104 presses a region of the upper part of the ink pack 33 except for a portion above a notch 40*a*, i.e., except for an F portion, by biasing force of the coiled springs 43. Therefore, most of the ink within the ink pack 33 is gathered into the F portion of FIG. 9A (see FIG. 9D), and then gradually discharged through an ink discharge port 32*a*.

According to the ink cartridge 131 of this embodiment, as described above, since the upper contact portion 104 and the lower contact portion 40 press the upper part and the lower part of the ink pack 33 by biasing force of the coiled springs 43, a pressed region of the ink pack 33 is larger than that of the first embodiment. This can economically reduce an amount of ink unusedly remaining within the ink pack 33.

The amount of ink within the ink pack 33 can be detected using, instead of the detection target 48*a* of the interlocker 48 and the reflective photosensor 52, the leaf switch 53 of FIG. 6, the transmissive photosensor 54 of FIG. 7, the ink amount detector 31 of FIGS. 8A to 8C, or combinations thereof.

Then, referring to FIGS. 10A and 10B, an ink cartridge according to a third embodiment of the present invention will be described. Here, the same members as in the above-described embodiment will be denoted by the common reference numerals, and descriptions thereof will be omitted.

Figure 10A:
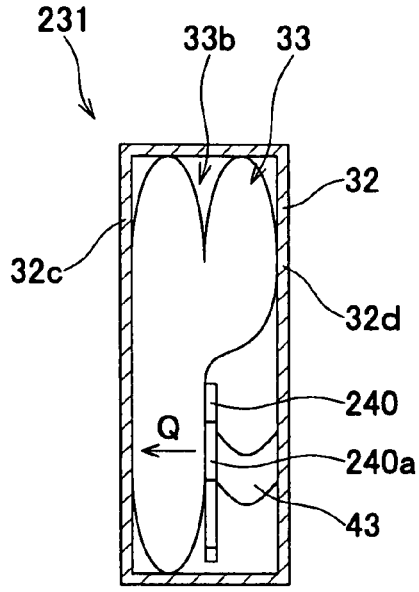
FIGS. 10A and 10B are schematic sectional views of an ink cartridge according to a third embodiment of the present invention.
Figure 10B:
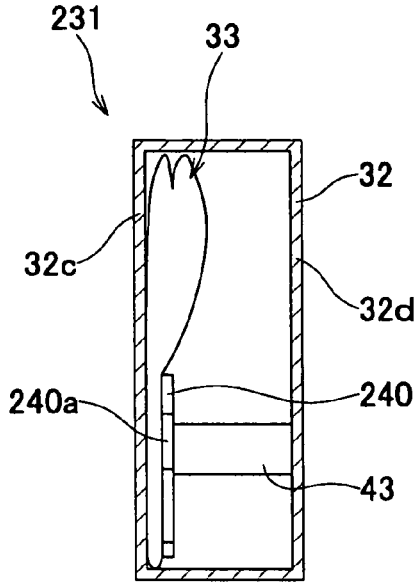

An ink cartridge 231 of this embodiment comprises a contact 240 that, differently from the contacts of the above-described embodiments, does not rotate and is movable along a width of the cartridge 231, i.e., along an arrow-Q direction in FIG. 10A. The other members are the same as in the first embodiment, so the ink cartridge 231 is also applicable to the ink-jet printer 1.

The contact 240 moves, by biasing force of the coiled springs 43, in the arrow-Q direction while standing in the vertical direction, and thereby presses a lower part of an ink pack 33. The contact 240 is not fixed onto a bottom face of a housing 32, but supported by coiled springs 43 whose biasing force allows a movement of the contact 240. The contact 240 has a notch 240*a* that is similar to the notch of the first embodiment.

This embodiment provides the same effect as that of the first embodiment that an amount of ink unusedly remaining within the ink pack 33 can be reduced, because the contact 240 presses the lower part of the ink pack 33 by biasing force of the coiled springs 43.

Figure 11A:
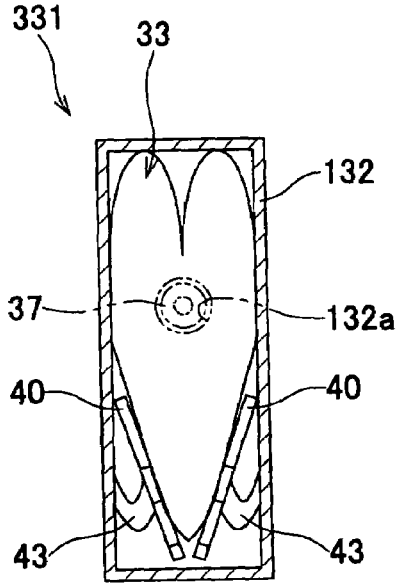
FIGS. 11A and 11B are schematic sectional views of an ink cartridge according to a forth embodiment of the present invention.
Figure 11B:
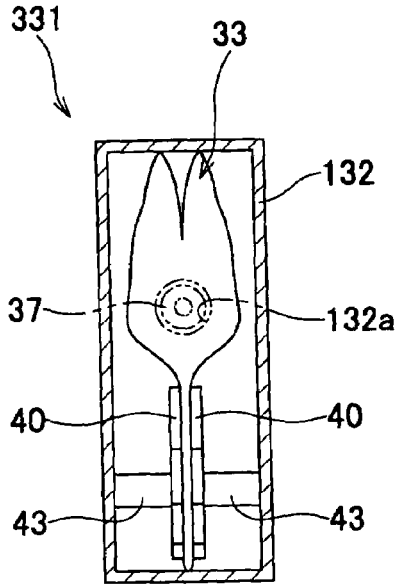

Then, with reference to FIGS. 11A and 11B, an ink cartridge according to a forth embodiment of the present invention will be described. Here, the same members as in the above-described embodiment will be denoted by the common reference numerals, and descriptions thereof will be omitted.

An ink cartridge 331 of this embodiment comprises two pairs of contact 40 and coiled springs 43 of the first embodiment. In addition, an ink discharge port 132*a* formed in a front face of a housing 132 is disposed substantially at a widthwise center, which is different from the above-described embodiments. The other members are the same as in the first embodiment, so the ink cartridge 331 is also applicable to the ink-jet printer 1.

The contacts 40 and the coiled springs 43 are disposed on both right and left sides of a lower part of an ink pack 33. A lower end of each contact 40 is fixed about a widthwise center of a bottom face of the housing 132. Each contact 40 is rotatable around its lower end.

When the ink pack 33 is filled up with ink, the two contacts 40 press the lower part of the ink pack 33 from both right and left sides of the ink pack 33 while symmetrically disposed in an inclining manner. Each of the contacts 40 is biased by the coiled springs 43.

As the amount of ink within the ink pack 33 decreases, the two contacts 40 rotate and get closer to each other. Subsequently, when the coiled springs 43 expand in the horizontal direction, the contacts 40 stop their rotation in a vertically-standing state, and completes pressing against the ink pack 33. At this time, the two contacts 40 sandwich the lower part of the ink pack 33 from both right and left sides thereof, and the ink within the ink pack 33 is gathered upward.

According to this embodiment, since the lower part of the ink pack 33 is pressed from its both sides, the ink within the ink pack 33 can be efficiently gathered upward and smoothly flown into the ink discharge port 132*a* to be discharged therefrom. Therefore, an amount of ink unusedly remaining within the ink pack 33 can advantageously be reduced.

The fold 33*b* can be formed not only on the top face of the ink pack 33 but also at any other suitable positions, or alternatively the ink pack 33 may lack a fold.

A biasing member that biases the contact is not limited to the coiled spring 43, but other elastic members, etc., can be employed as long as the members can bias the contact toward the ink pack. In addition, the coiled spring 43 may not necessarily stay buckled when ink is unused.

It is not always required that the ink discharge port 32*a* or 132*a* is disposed near a portion where the upper end of the contact 40 is positioned after completion of pressing against the ink pack 33, but it can be disposed at any other suitable positions.

In the first embodiment, the opening 35*a* formed at one end of the spout 35 is, in comparison with the opening 35*b* formed at the other end thereof, more deviated toward the sidewall 32*c* of the housing 32. However, this is not limitative.

The notch 40*a* may not be formed at the portion of the contact 40 near to the ink discharge port 32*a*.

Although, in the first and second embodiments, the detection target 48*a* is positioned away from the center of rotation of the interlocker 48, the detection target 48*a* can be positioned at any suitable position.

Moreover, the interlocker 48, which is formed integrally with the contact 40 in the embodiments, can be separate from the contact 40. The interlocker 48 is not an essential element but can be omitted. The means 52, 53, and 54 for detecting the interlocker 48 can also be omitted.

It is not necessary to provide a special detection means for detecting completion of pressing by the pressing mechanism 400 or for detecting the position of the contact 40.

It is not necessary to form an opening, such as the second detection window 32*b* formed in the rear face of the housing 32, which enables the contact 40 to be visually observed from the outside.

The ink cartridge of the present invention can be applied to both line-type and serial-type ink-jet printers.

Further, an application of the present invention is not limited to ink-jet printers. The present invention is also applicable to, for example, ink-jet type facsimile machines or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink cartridge comprising:

a housing having a plurality of vertical walls each extending in a vertical direction, at least one of the vertical walls being vertically long, the housing having an ink discharge port provided in one of the vertical walls;

an ink pack that stores ink, the ink pack having an opening for discharging ink and being disposed within the housing, the opening being connected to the ink discharge port; and a pressing mechanism that presses the ink pack, wherein the pressing mechanism includes:

a contact that is movably disposed within the housing and is in contact with a part of the ink pack lower than the opening; and a biasing member that biases the contact toward the ink pack, the biasing member being positioned between the contact and one of the vertical walls of the housing with one end and the other end thereof respectively connected to the contact and the one vertical wall.

2. The ink cartridge according to claim 1, wherein the contact is rotatable around its lower end.

3. The ink cartridge according to claim 1, wherein the biasing member is a coiled spring which stays buckled when ink is unused.

4. The ink cartridge according to claim 1, wherein a fold is formed in the ink pack.

5. The ink cartridge according to claim 1, wherein the fold is formed on a top face of the ink pack.

6. The ink cartridge according to claim 1, wherein the opening is disposed above a portion where an upper end of the contact is positioned after completion of pressing against the ink pack.

7. The ink cartridge according to claim 1, wherein the contact is a plate-like member and has a notch formed at a portion thereof near to the opening.

8. The ink cartridge according to claim 1, wherein:

the contact rotates around its lower end by biasing force of the biasing member so as to press a part of the ink pack lower than the opening; and the ink cartridge further comprising an upper contact connected to an upper end of the contact at a variable angle to the contact is in contact with a part of the ink pack higher than a part contact with the contact, and, with rotation of the contact, presses a part of the ink pack higher than the part contact with the contact.

9. The ink cartridge according to claim 1, comprising:

two contacts that are in contact with the ink pack from both sides thereof; and two biasing members that correspond to the respective two contacts.

10. The ink cartridge according to claim 1, wherein:

the housing has a first side wall and a second side wall;

the pressing mechanism presses the ink pack toward the first side wall;

the ink discharge port is provided in the second side wall; and the ink discharge port is deviated toward the first side wall from a center of the second side wall in a horizontal direction.

11. The ink cartridge according to claim 10, wherein:

the housing forms an angular cylinder having a plurality of sidewalls;

the pressing mechanism presses the ink pack toward a first sidewall of the housing; and the ink discharge port is provided in a second sidewall of the housing connected with the first sidewall in a direction substantially perpendicular thereto, the ink discharge port being deviated toward the first sidewall from a center of the second sidewall in a horizontal direction.

12. The ink cartridge according to claim 10, wherein:

an ink discharger is connected to the ink discharge port, the ink discharger having one end connected to an opening of the ink pack, the other end facing an outside of the housing, and a through-hole extending from the one end to the other end; and an opening of the through-hole at the one end of the ink discharger is more deviated toward the first side than another opening of the through-hole at the other end of the ink discharger is.

13. The ink cartridge according to claim 1, further comprising, within the housing, an interlocker that interlocks with the contact and stays away from the ink pack while the contact is pressing the ink pack by biasing force of the biasing member.

14. The ink cartridge according to claim 13, further comprising a sensor that detects the interlocker.

15. The ink cartridge according to claim 13, wherein:

the contact is a plate-like member; and the interlocker is formed integrally with the contact by notching a portion of the plate-like member near to the opening.

16. The ink cartridge according to claim 13, wherein the interlocker is rotatable together with the contact and has a detection target that is formed away from its center of rotation.

17. The ink cartridge according to claim 1, wherein the housing has an opening that enables the contact to be visually observed from outside.

18. The ink cartridge according to claim 1, further comprising an ink amount detector that is a member separate from the contact and moves depending on an amount of ink within the ink pack.

19. An ink-jet recording apparatus comprising:

an ink-jet head having an ink ejection face in which a plurality of nozzles that eject ink toward a recording medium are formed; and an ink cartridge according to claim 1 being vertically mounted that stores ink to be supplied to the ink-jet head.

20. The ink-jet recording apparatus according to claim 19, further comprising a maintenance unit that performs maintenance on the ink-jet head, locates lower than the ink-jet head, and moves in parallel to the ink ejection face to thereby selectively take a position where the maintenance unit confronts the ink ejection face in a vertical direction and a position where the maintenance unit does not confront the ink ejection face in the vertical direction, wherein the ink cartridge is disposed lower than the maintenance unit.

21. The ink cartridge according to claim 1, wherein the opening is positioned higher than a vertical center of the ink pack.

22. An ink cartridge comprising:

a housing having a plurality of vertical walls, each extending in a vertical direction, at least one of the vertical walls being vertically long, the housing having an ink discharge port provided in one of the vertical walls;

an ink pack that stores ink, the ink pack having an opening for discharging ink and being disposed within the housing, the opening being connected to the ink discharge port; and a pressing mechanism that presses the ink pack, wherein the pressing mechanism includes:

a contact that is disposed within the housing, and is rotatable around a lower end of one of the vertical walls so as to press the ink pack toward the vertical wall; and a biasing member that biases the contact toward the ink pack, the biasing member being positioned between the contact and one of the vertical walls of the housing with one end and other end thereof respectively connected to the contact and the one vertical wall, wherein the contact is a plate-like member which is in contact with substantially entire part of the ink pack lower than the opening, and wherein the opening is disposed on a vertical plain, on which the contact after completion of pressing against the ink pack is positioned.

23. An ink cartridge comprising:

a housing having a plurality of vertical walls, each extending in a vertical direction, at least one of the vertical walls being vertically long, the housing having an ink discharge port provided in one of the vertical walls;

an ink pack that stores ink, the ink pack having an opening for discharging ink and being disposed within the housing, the opening being connected to the ink discharge port; and a pressing mechanism that presses the ink pack, wherein the pressing mechanism includes:

two contacts that are disposed within the housing, and are rotatable around a lower end of the housing so as to press the ink pack from both sides thereof; and two biasing members that correspond to the respective two contacts, and bias the contacts toward the ink pack, the biasing members respectively being positioned between a corresponding contact and one of the vertical walls of the housing with one end and other end thereof respectively connected to the corresponding contact and one of the vertical walls, wherein the contacts are plate-like members which are in contact with substantially entire part of the ink pack lower than the opening, and wherein the opening is disposed on a vertical plain, on which the contacts after completion of pressing against the ink pack are positioned.

* * * * *